US009114858B2

(12) United States Patent
Tomas

(10) Patent No.: US 9,114,858 B2
(45) Date of Patent: Aug. 25, 2015

(54) SUBSEA ANCHORING ASSEMBLY

(75) Inventor: Julek Romuald Tomas, Aberdeen (GB)

(73) Assignee: Subsea 7 Limited, Sutton (GB)

( * ) Notice: Subject to any disclaimer, the term of this patent is extended or adjusted under 35 U.S.C. 154(b) by 198 days.

(21) Appl. No.: 13/824,534

(22) PCT Filed: Sep. 19, 2011

(86) PCT No.: PCT/GB2011/051756

§ 371 (c)(1),
(2), (4) Date: Aug. 7, 2013

(87) PCT Pub. No.: WO2012/038729

PCT Pub. Date: Mar. 29, 2012

(65) Prior Publication Data

US 2014/0014021 A1 Jan. 16, 2014

(30) Foreign Application Priority Data

Sep. 22, 2010 (GB) ..... 1015888.9

(51) Int. Cl.

| | |
|---|---|
| ***B63B 21/24*** | (2006.01) |
| ***B63B 21/04*** | (2006.01) |
| ***B63B 21/20*** | (2006.01) |
| *B63B 21/26* | (2006.01) |
| *B63B 21/50* | (2006.01) |

(52) U.S. Cl.

CPC ..... *B63B 21/24* (2013.01); *B63B 21/04* (2013.01); *B63B 21/20* (2013.01); *B63B 21/26* (2013.01); *B63B 21/502* (2013.01); *B63B 2021/203* (2013.01)

(58) Field of Classification Search

CPC ..... B63B 21/50; B63B 21/502; B63B 21/00; B63B 21/24; B63B 21/27

USPC ..... 114/294; 405/223.1, 224, 224.1

See application file for complete search history.

(56) References Cited

U.S. PATENT DOCUMENTS

| | | | | |
|---|---|---|---|---|
| 3,901,610 | A | 8/1975 | Mason | |
| 4,320,993 | A * | 3/1982 | Hunter | 405/224 |
| 4,746,247 | A | 5/1988 | Arlt, III | |
| 4,943,188 | A * | 7/1990 | Peppel | 405/223.1 |
| 5,054,963 | A | 10/1991 | Williamsson | |
| 6,554,541 | B1 | 4/2003 | Antonsen | |
| 6,835,025 | B1 * | 12/2004 | Beard et al. | 405/224 |

FOREIGN PATENT DOCUMENTS

| | | |
|---|---|---|
| EP | 0 311 398 | 4/1989 |
| GB | 1 604 358 | 12/1981 |
| JP | 60-240594 | 11/1985 |

* cited by examiner

*Primary Examiner* — Lars A Olson
(74) *Attorney, Agent, or Firm* — Levy & Grandinetti

(57) ABSTRACT

A subsea anchoring assembly with a locking head for connection of a mooring line to an anchor is disclosed. A socket is provided on the anchor. The socket has a seat adapted to receive and seat the locking head within it. The socket has a neck provided with a guide device to direct the locking head into alignment with the socket. By this arrangement, the locking head and the socket can move between a first configuration in which the locking head and the socket are separate, and a second configuration in which the locking head and the socket are locked together. An associated method is also described.

32 Claims, 15 Drawing Sheets

SUBSEA ANCHORING ASSEMBLY

This Application is the U.S. National Phase of International Application Number PCT/GB2011/051756 filed on Sep. 19, 2011, which claims priority to Great Britain Application No. 1015888.9 filed on Sep. 22, 2010.

The present invention relates to an anchoring assembly for and method of anchoring an object in water. Typical embodiments allow an object to be tethered to an anchor, which can typically be a seabed anchor, although in some embodiments, the anchor need not be located on the seabed. The object being anchored can typically be buoyant and can be floating on the surface of the water (e.g. the sea) or can be submerged in the water. In typical embodiments the object can be a buoy (e.g. a subsea production buoy) submerged at depth beneath the surface of the sea or other body of water. The object may be attached to the anchoring point by a mooring line such as a rope (e.g. wire rope, fibre rope etc) and may be used to attach a subsea production buoy to an anchor (e.g. a suction anchor, driven pile, percussion pile, or gravity base etc) on the seabed. Such buoys are often used in deep water hydrocarbon production facilities. The invention also provides a method for anchoring an object.

When producing oil from production fields located in deep water, a floating production, storage and offloading (FPSO) vessel can be provided at a location suitably near to the oil field as an alternative to or in addition to production platforms. The produced fluids are recovered from the subsea well(s) to pipelines laid on the seabed. These pipelines extend from the seabed to the FPSO where the produced fluids are processed and stored before being transported, normally by tanker, to an onshore facility for further processing.

It is known to connect the pipeline laid on the seabed and FPSO using a riser such as a steel catenary riser (SCR). The SCR is suspended in the water from a subsea buoy which is typically anchored to the seabed. The SCR extends from the pipeline on the seabed to the subsea buoy where it is coupled, through a suitable connection, to a flexible riser. The flexible riser typically extends between the subsea buoy and the FPSO. This connection system is sometimes called a "de-coupled system" since heave motion of the surface vessel is de-coupled from the pipeline on the seabed and subsea buoy.

All subsea structures and particularly subsea production buoys are susceptible to the forces of tidal flow and other underwater currents that move the buoy relative to its anchor point. In use, the tethers and buoys attached thereto move relative to the anchor point(s). Repeated movement over of time weakens one or more links between two component parts of the assembly and the anchor.

According to a first aspect of the present invention there is provided a subsea anchoring assembly, comprising:

a locking head for connection of a mooring line to an anchor;

a socket provided on the anchor and having a seat adapted to receive and seat the locking head within the socket;

the socket having a neck provided with a guide device to direct the locking head into alignment with the socket;

wherein the head and the socket can move between a first configuration in which the head and the socket are separate, and a second configuration in which the head and the socket are locked together.

The invention also provides a method of anchoring an object to a subsea anchor, the method comprising:

providing a locking head on a mooring line;

providing an anchor having a socket and a seat adapted to receive and seat the locking head within the socket, wherein the socket has a neck provided with a guide device to direct the locking head into alignment with the socket; and moving the head into alignment with the socket, moving the head into the socket and locking the head within the socket.

The guide device can optionally have splayed arms (typically a pair of splayed arms) that extend from the socket, typically in different directions, to guide the head or mooring line laterally into the neck of the socket.

Typically the guide device engages the mooring line or the head, and directs it through the neck and into the socket.

Typically the head can have a latching device, optionally in the form of a spigot which can engage in a recess and can be locked in the recess by a locking member. Typically the locking member restricts or prevents movement of the spigot out of the recess, and thus movement of the head out of the socket is prevented. The spigot is typically retained in the recess by a locking device, optionally in the form of one or more locking pins, which permit the spigot to move into the recess, but restrict movement of the spigot out of the recess. When the spigot is located in the recess, the head is typically axially aligned with the seat on the socket. Thus retention of the spigot in the recess maintains the alignment of the head and the seat.

The subsea anchoring assembly can optionally have a ramp adapted to guide the head or the mooring line through the neck and into the socket. Typically the ramp can be below the socket. Typically the head is moved up the ramp. Moving the spigot up the ramp typically moves the head at least partially into the socket. When the head has moved up the ramp the head is typically in axial alignment with the seat and can optionally be axially spaced away from the seat ready to be pulled up when the mooring line is tensioned so that the head locates in the seat in the locked configuration.

The ramp can typically have legs with a groove between them. The legs can be provided in the form of a fork, and the spigot optionally extends between the forked legs of the ramp, locating in the recess between the legs. The legs can be splayed, extending at the same angles as the splayed arms. Typically the legs of the ramp are parallel to the splayed arms. The recess can be axially aligned with the socket.

The spigot is typically guided between the legs of the ramp thereby guiding the head into the socket. The ramp can be provided with latch pins to retain the spigot within the recess of the ramp.

Typically the seat on the socket faces the ramp. In some embodiments of the invention, the seat faces downwards, to react against an upward pull on the mooring line.

Typically the seat is partially spherical, and typically engages with a spherical or partially spherical bearing on the head, whereby the head is able to pivot and swivel in the seat, which can reduce fatigue experienced by the assembly.

Typically the socket has a radially outer wall surrounding at least a part of the seat, retaining the head in the socket. The wall can be annular and can surround the whole of the seat, or can be discontinuous, and can be circumferentially spaced apart around the outer circumference of the seat. The wall typically faces the ramp, typically extending downwards from the seat, so that when the head is seated in the socket (the locked configuration of the assembly), the wall restricts the lateral movement of the head out of the seat.

The head typically extends axially between the socket and the ramp.

Optionally the guide device comprises a pair of splayed arms with inner ends that define the entrance to the neck and free outer ends that diverge from one another. In some embodiments, the guide device can comprise a landing enclosure with a substantially continuous boundary extending from one side of the neck to the other. This can optionally be formed by extending the outer ends of the arms so that they connect to one another to form the boundary, which typically has a larger inner diameter than the internal diameter of the socket. In certain embodiments, the landing enclosure provides an easier target to land the head from above, before moving it laterally through the neck. The landing enclosure can optionally be annular, although other shapes can be used. The entrance to the neck typically has arcuate walls to guide the mooring line or the head into the neck, and into alignment with the socket.

Optionally, the head can have a boot, typically in the form of a cone on top of the head which guides the head laterally onto the seat. The head can optionally have a bearing surface to engage the seat. The bearing surface can optionally be located below the boot. The boot can optionally restrict lateral movement of the head in the socket. The boot is optionally removable from the head after seating of the head in the socket, typically when the bearing surface of the head is engaged with the seat. The boot can optionally centralise the bearing during installation, and can prevent or reduce debris entering the bearing area from above. It can optionally be left in place during the operation of the assembly.

Optionally the spigot permits articulation (e.g. swiveling and/or pivoting) of the head within the socket when the head is locked in the socket (e.g. engaged in the seat), and can optionally be dimensioned to clear the legs of the ramp when the head is engaged in the seat, so that when the head is fully engaged in the seat, the head can pivot relative to the socket.

Optionally there can be more than one locking head and socket on each anchor. For example, in some embodiments, two, three or four sockets (or more) can be provided on one anchor, allowing connection of two, three, four or more mooring lines. Optionally where more than one socket is provided on an anchor, the sockets are spaced apart to restrict the extent to which the mooring lines interact with one another, e.g. by a spacing of 4-7 m, e.g. 5-6 m.

Typically the seat and the bearing surface on the head have cooperating (e.g. matching) engaging surfaces. Typically the surfaces are at least partially spherical bearing surfaces. The interface between the head and the socket may be a bearing surface. The bearing surfaces may comprise a layer or coating of low friction material to reduce friction between the head and the socket. The bearing surfaces may comprise an engineered composite material such as D-Glide or the like; a laminated elastomeric material; PTFE; fluoropolymer material, or a rubber.

Optionally the end of the mooring line can be formed into the head, typically by moulding at least a portion of the head around the end of the line.

The inner diameter of the landing enclosure may be up to three times the inner diameter of the socket. Preferably the inner diameter of the landing enclosure is twice the inner diameter of the socket.

The head may comprise a ball secured to an end of the mooring line.

A landing enclosure can optionally be provided with more than one socket that is contiguous with the landing enclosure.

The head can optionally have a sleeve. The sleeve can optionally have a flange engaging the seat.

Embodiments of the invention allow a flexible mooring system that can be made up and disengaged when located subsea.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one embodiment can typically be combined alone or together with other features in different embodiments of the invention.

Various embodiments and aspects of the invention will now be described in detail with reference to the accompanying figures. Still other aspects, features, and advantages of the present invention are readily apparent from the entire description thereof, including the figures, which illustrates a number of exemplary embodiments and aspects and implementations. The invention is also capable of other and different embodiments and aspects, and its several details can be modified in various respects, all without departing from the spirit and scope of the present invention. Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including", or "is" preceding the recitation of the composition, element or group of elements and vice versa.

All numerical values in this disclosure are understood as being modified by "about". All singular forms of elements, or any other components described herein are understood to include plural forms thereof and vice versa.

Figure 1:
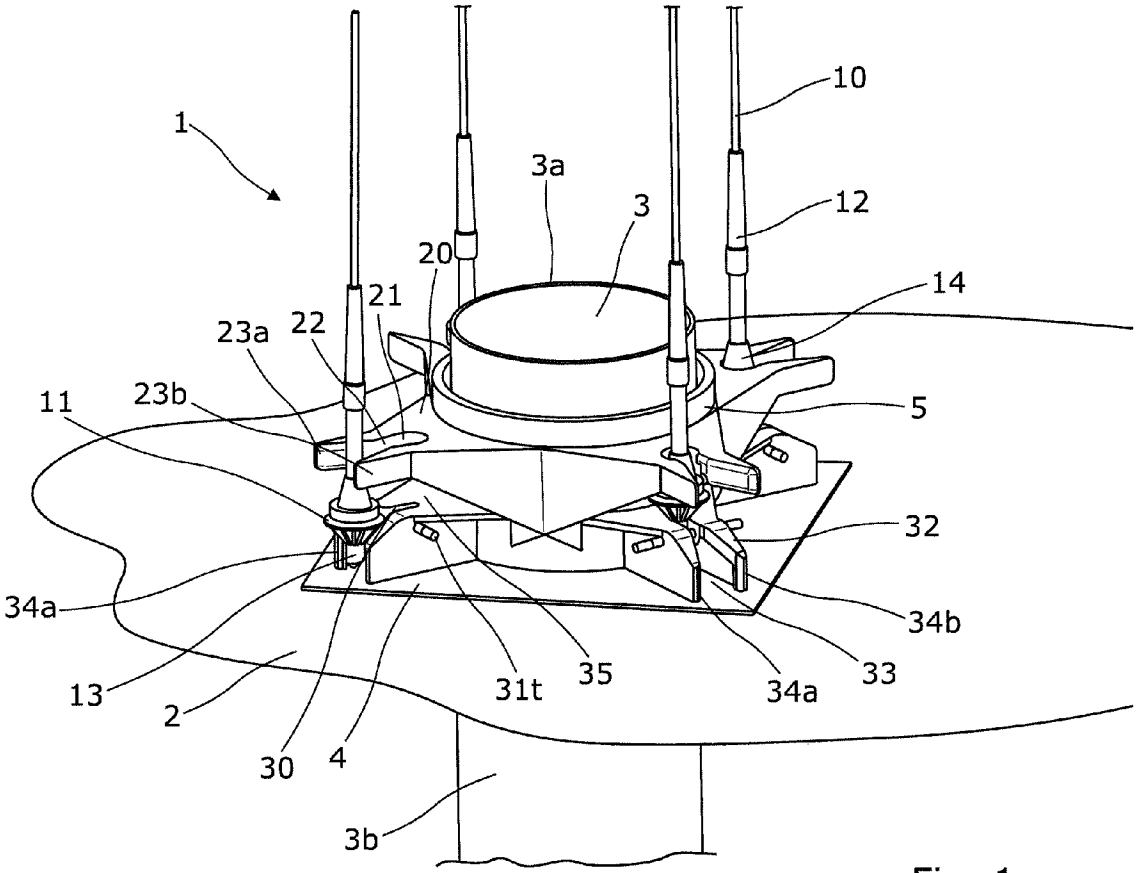
FIG. 1 is a perspective view of a subsea anchoring assembly installed on the seabed.
Figure 4:
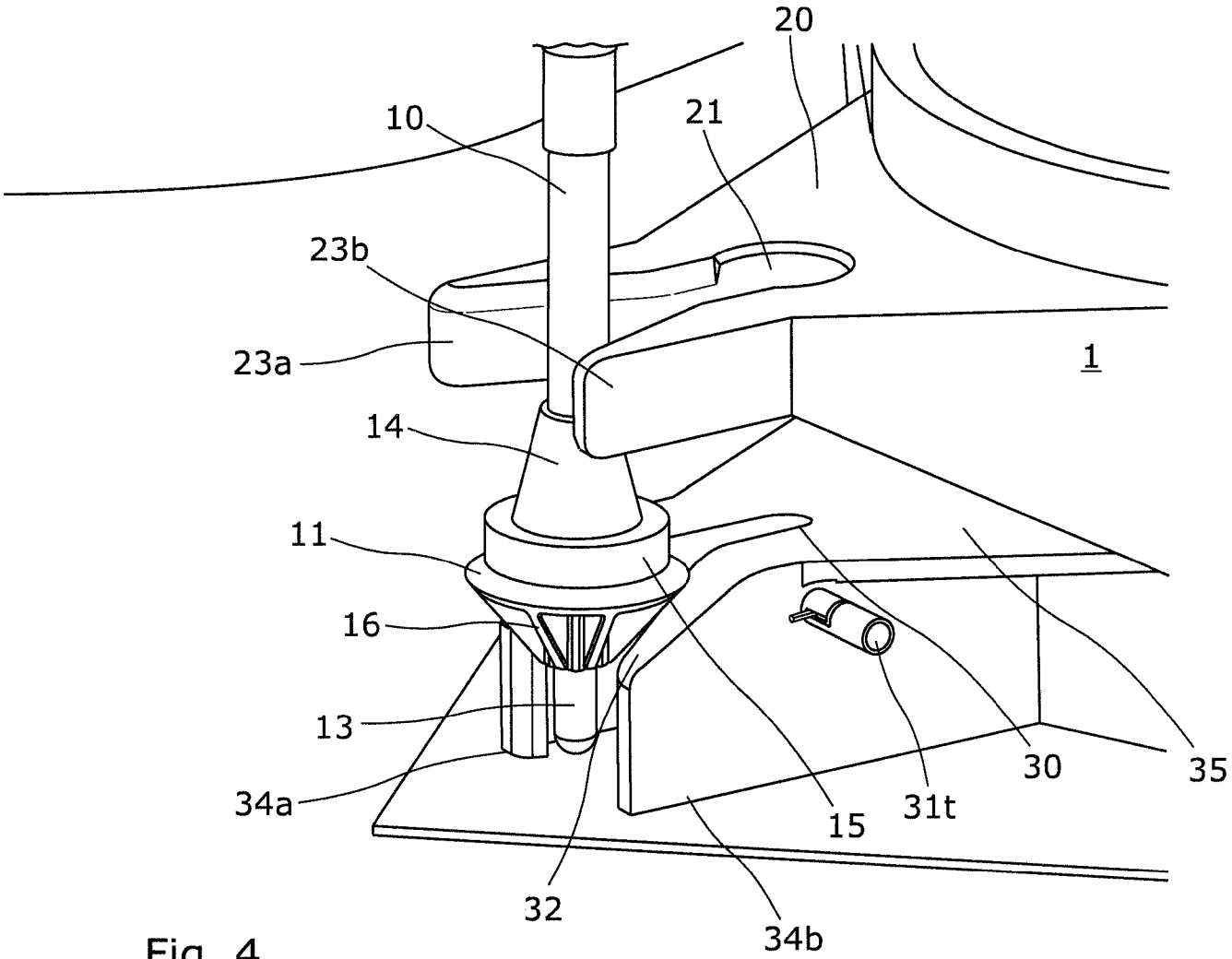
Figure 5:
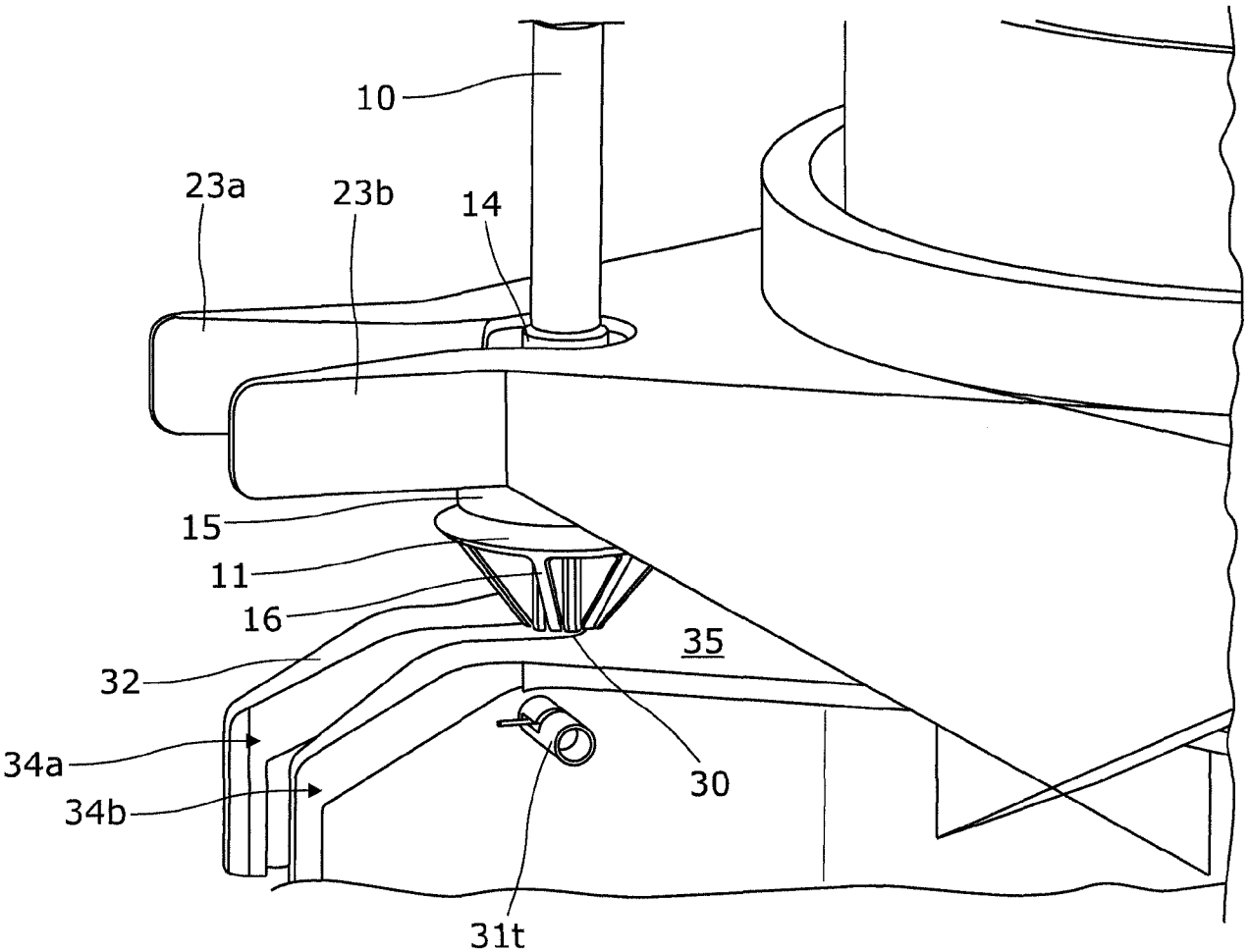
Figure 6:
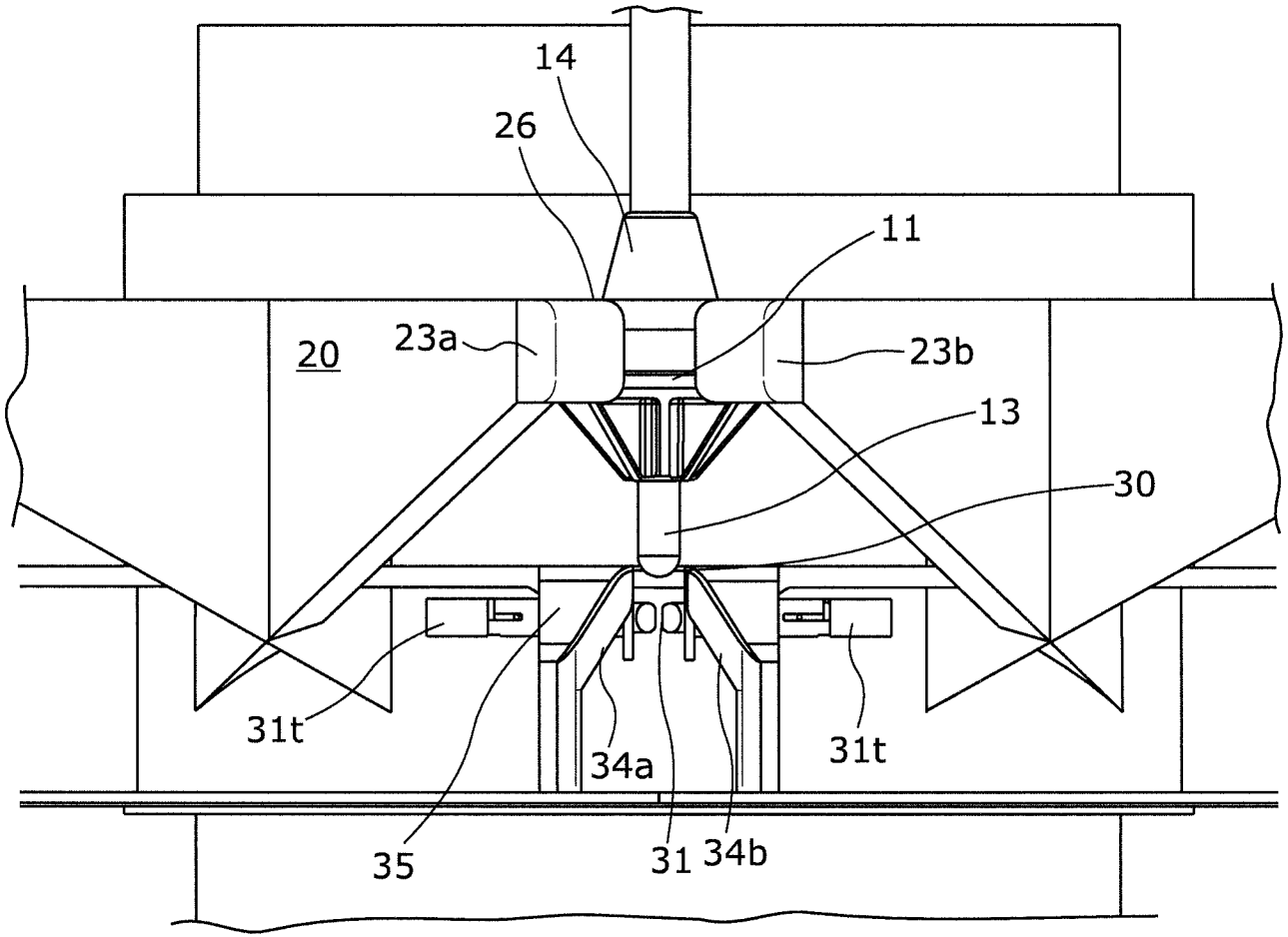
Figure 7:
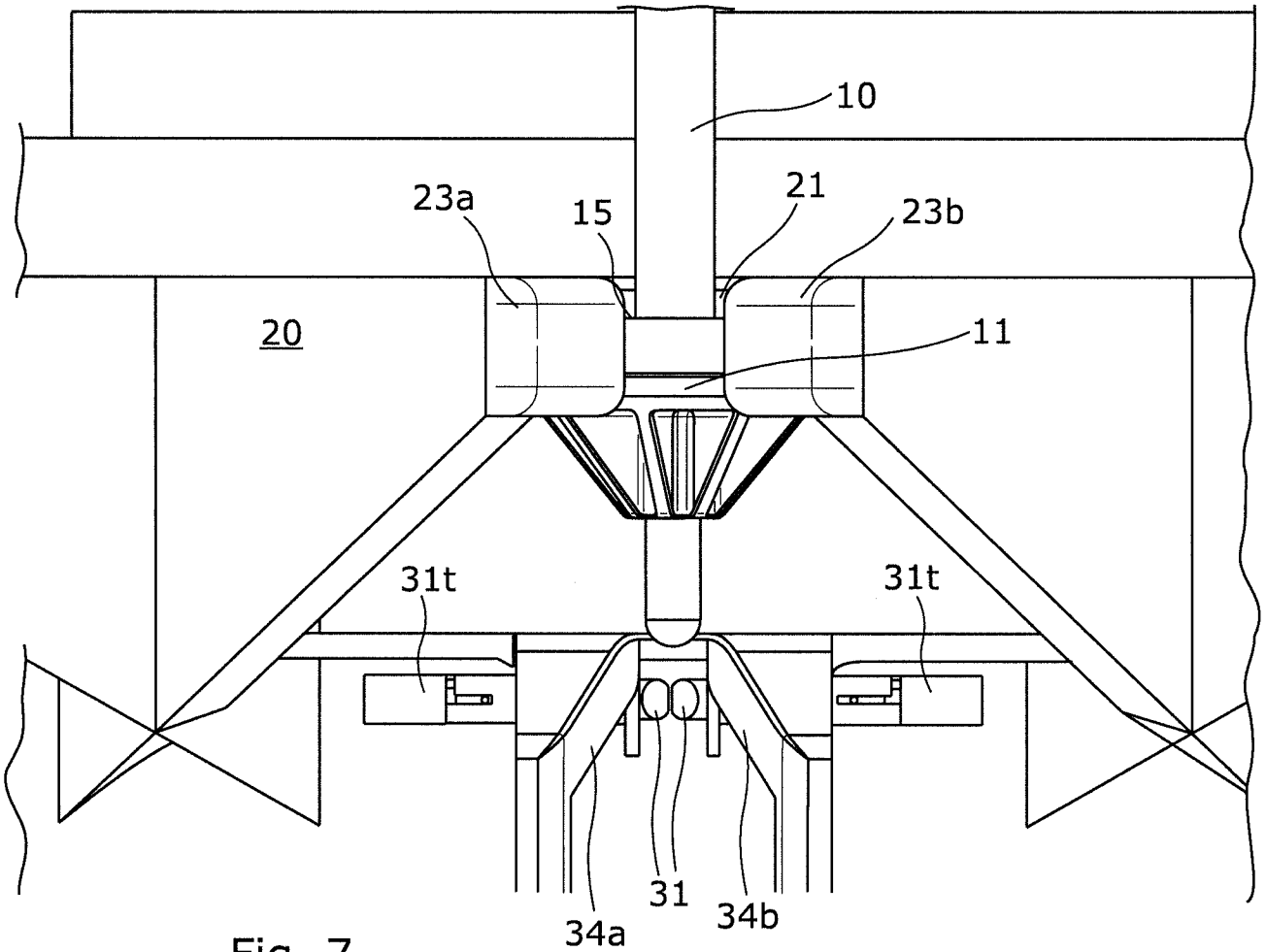
Figure 8:
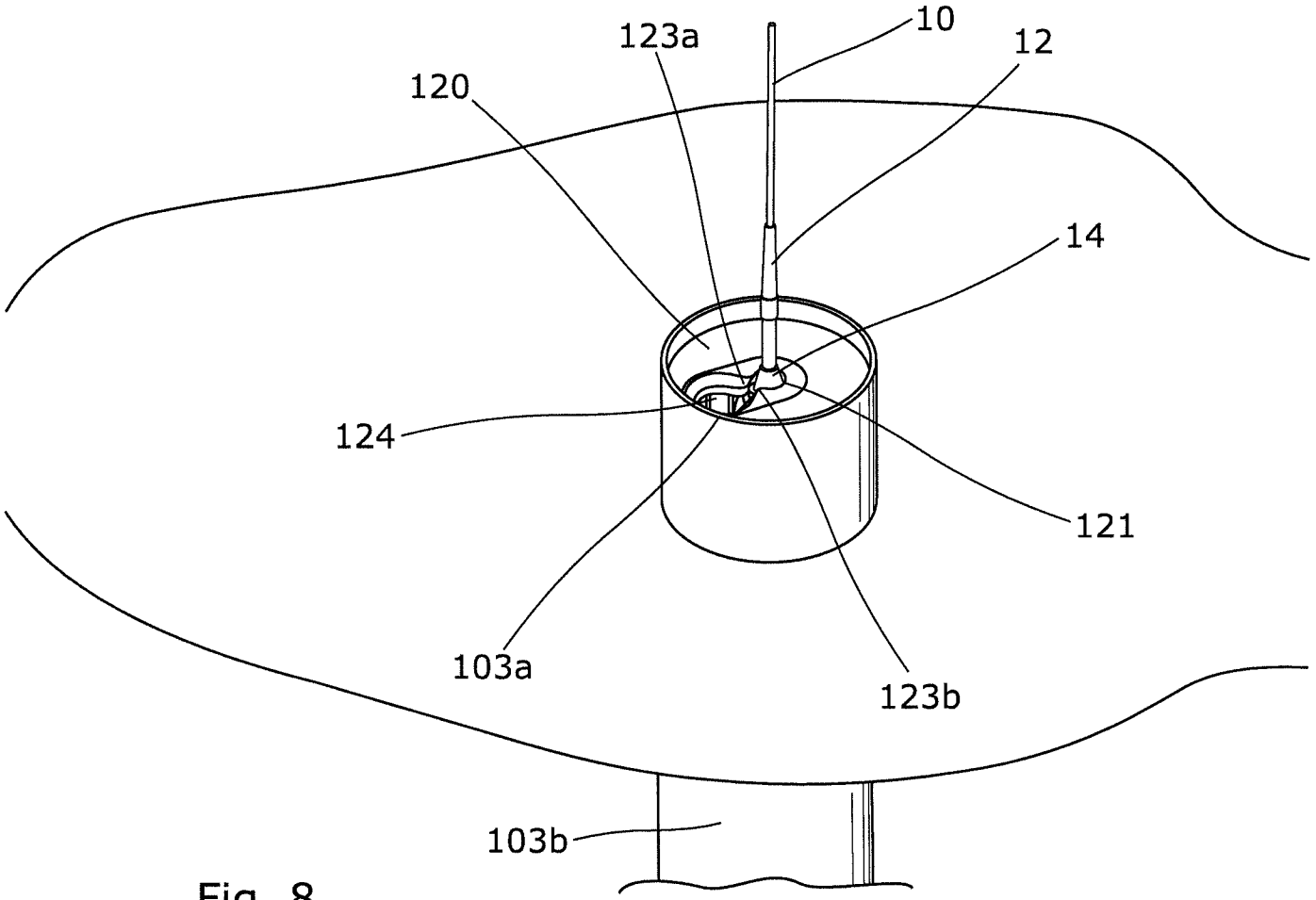
Figure 9:
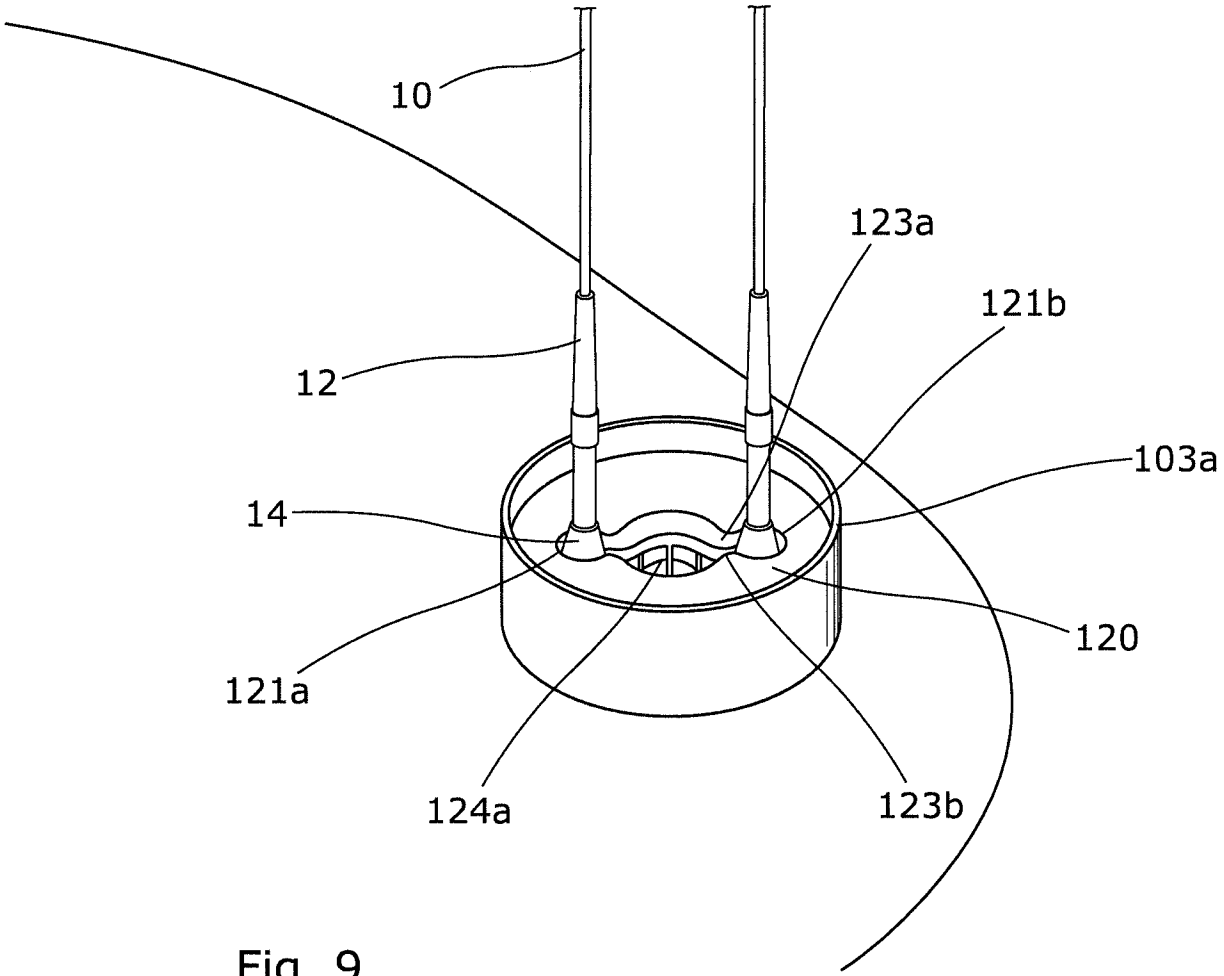
Figure 10A:
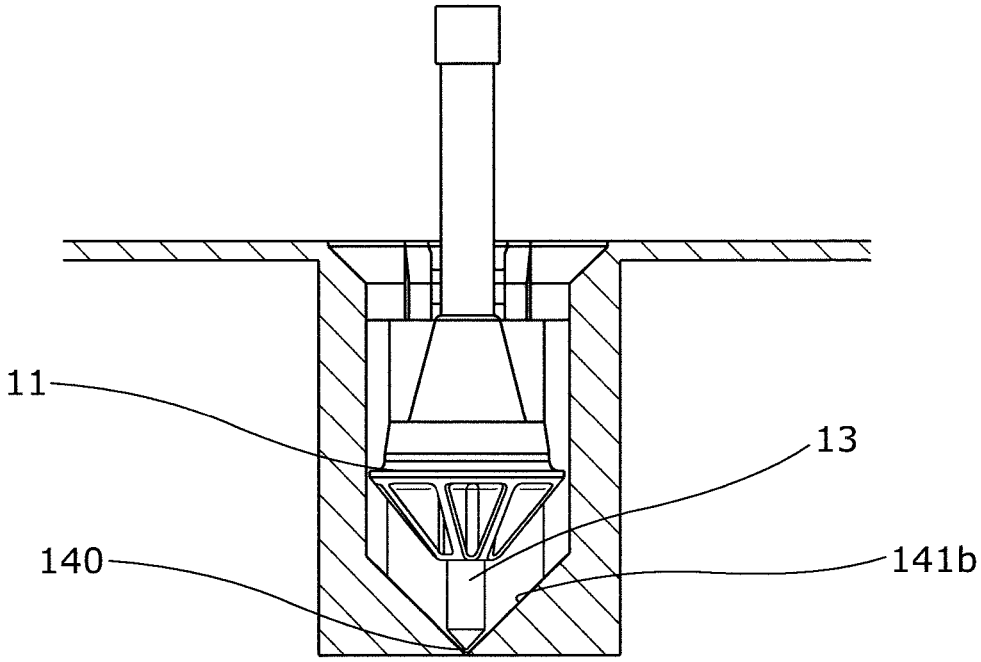
Figure 10B:
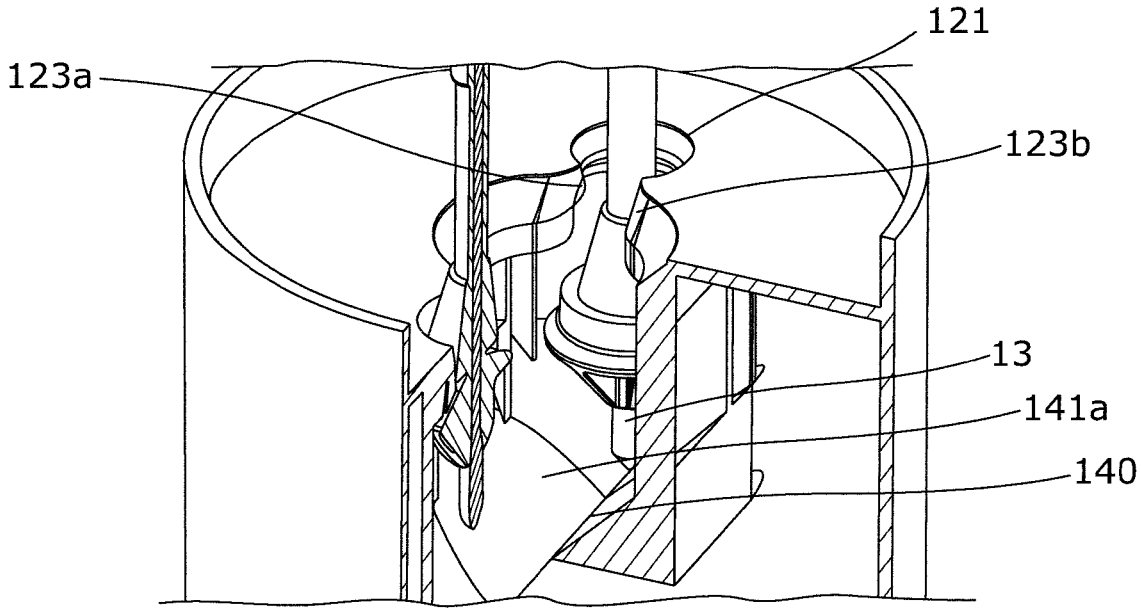

FIGS. 3A-F are a series of views of a socket and ramp of the FIG. 1;

FIGS. 4 and 5 are perspective views and FIGS. 6 and 7 are front views of a porch of the FIG. 1 assembly showing various steps involved in the attachment of the mooring line to the subsea anchor;

FIGS. 8 and 9 are perspective views of an alternative arrangement of anchoring assembly;

FIGS. 10 A and B show a cross section and a perspective view of the alternative arrangement shown in FIGS. 8 and 9;

FIG. 11A-F show different views of the socket and guide device of FIGS. 8-10; and FIGS. 12A-E show different views of the locking head at the end of the mooring line.

Figure 2:
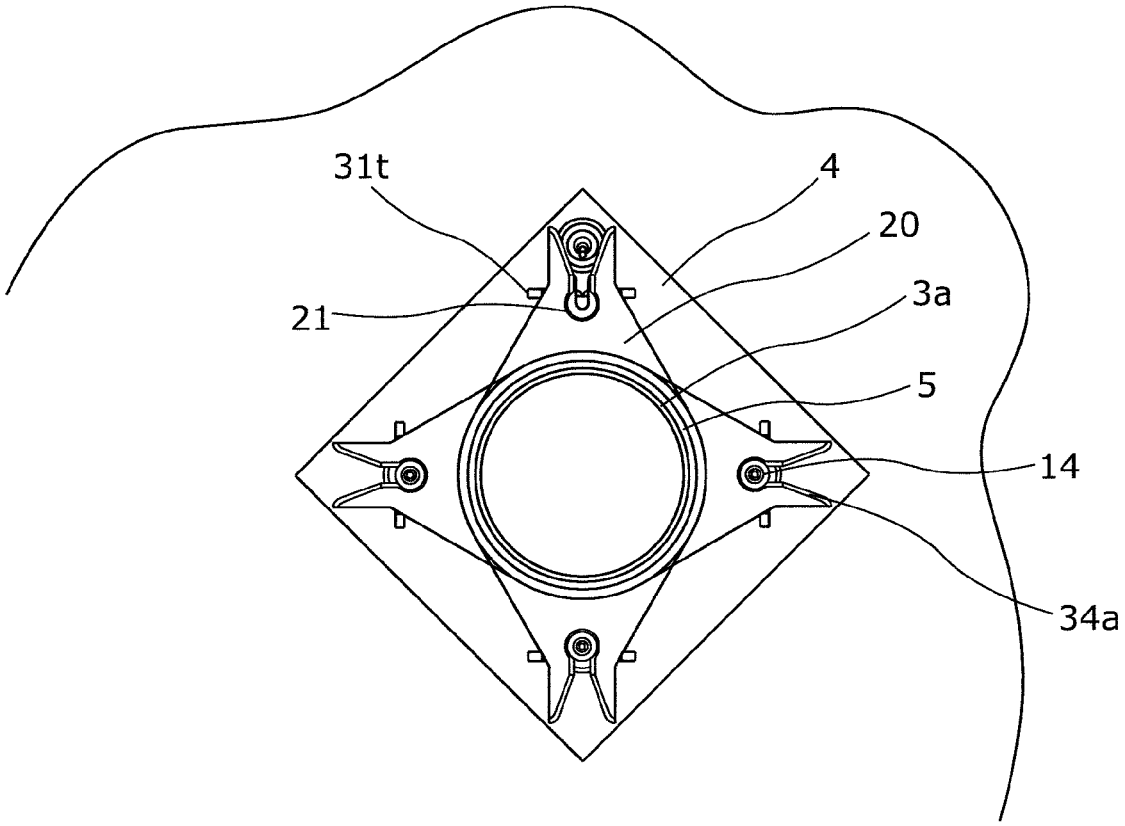
FIG. 2 is a plan view of the subsea anchoring assembly of FIG. 1.

Referring to FIGS. 1 and 2, there is shown a subsea anchor 1 installed on the seabed 2. A mooring line 10 and locking head 11 is made up to and disengaged from the subsea anchor 1 when located subsea.

The subsea anchor 1 is attached to a pile 3 that extends above 3*a* and below 3*b* the seabed 2. The pile can optionally be a suction pile, or can be a driven pile. A plate or mud mat 4 separates the anchor 1 from the seabed 2 to help prevent sediment from the seabed 2 fouling component parts of the subsea anchor 1. Mooring lines 10 connect a subsea buoy (not shown, but typically submerged in water above the anchor 1) to the anchor 1. Each mooring line 10 has a locking head 11 at its lowermost end. The locking head 11 provides the connection between the mooring line 10 and subsea anchor 1. The mooring line 10 has a sleeve 12 that extends around the lowermost end of the mooring line 10. A boot 14 extends around the lowermost end of the sleeve 12 and covers the top of the locking head 11.

The subsea anchor 1 has porches 20 projecting radially out from the side wall of the pile 3. Each porch 20 has a socket 21 into which the locking head 11 can be secured. The socket 21 has a neck 22 defining an opening to the socket 21. A guide device having arms 23*a* and 23*b* extends from the neck 22. In use the arms 23*a* and 23*b* direct the mooring line 10 through the neck 22 and into the socket 21. The guide arms 23*a*, 23*b* are typically splayed outwards to facilitate the guiding of the mooring line or the locking head 11 between the arms 23 and into the neck 22.

The lowermost end of the head 11 has a spigot 13 extending axially downwards from the head 11. The spigot 13 typically engages in a recess 30 of a latch block 35. The spigot 13 is locked in the recess 30 by latch pins 31 extending from horizontal pin tubes 31*t* typically housing resilient springs that bias the pins 31 inwardly from the tubes 31*t*. The latch pins 31 are typically restrained in alignment with one another on each side of the opening to the recess 30, and are typically resiliently biased inwards to close together and resist separation of the pins 31, and thus resist passage of the spigot into and out of the recess 30. The inner ends of the pins 31 are chamfered to create a "V" shape which allows modest forces to separate the pins 31 to allow passage into the recess 30 but the chamfer is typically only on the outside edge of the pins 31 so the pins 31 therefore resist separation in response to forces pushing the spigot 13 out of the recess 30. Therefore, the pins 31 retain the spigot within the recess 30.

The latch block 35 typically has a ramp 32 arranged below the socket 21. The ramp 32 slopes upward towards the recess 30, to guide the locking head 11 upwards towards the socket 21. The spigot is received in the groove 33 between legs 34 of the ramp 32 and is thereby guided into the recess 30. Therefore, the ramp and recess guide the axial and lateral movement of the head (via the legs 34 and the recess 30 acting on the spigot 13) to the top of the ramp into a location where the axis of the head 11 is coaxial with the axis of the socket 21 located above the recess 30.

In certain alternative embodiments (not shown) the ramp does not require a groove between the legs 34 and provides a planar surface without the groove 33. The head then acts on the face of the ramp 32 to guide the head towards the socket 21.

The porch 20 and latch block 35 are held down on the pile 3*a* by a retaining ring 5. Optionally the porch can form part of the pile e.g. it can be integral with the pile structure itself. In some cases, the porch(es) can be formed separately from the pile and connected to the pile after or during installation of the pile, e.g. by grouting, swaging, pinning, clamping etc.

FIGS. 1 and 2 show a subsea anchor 1 with four porches 20 and four mooring lines 10. In alternative embodiments there may be any number of porches 20 and tethers 10, e.g. 1, 2, 3 or more than 4.

The pile may be a driven pile such as that shown in FIGS. 1 and 2 or alternatively may be a suction or gravity pile.

Figure 3A:
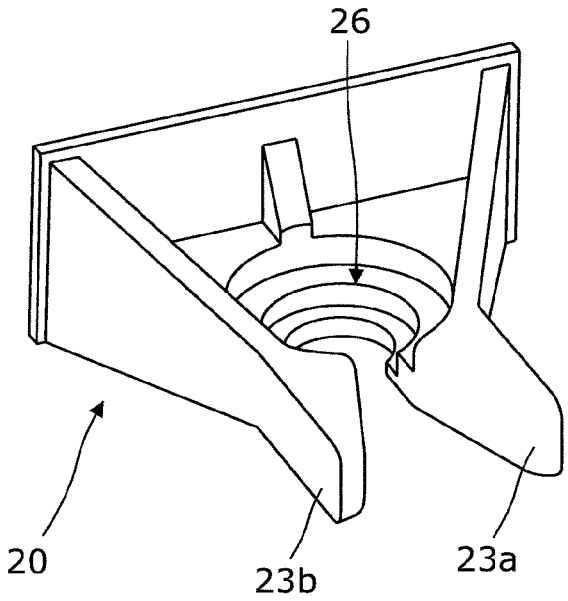
Figure 3B:
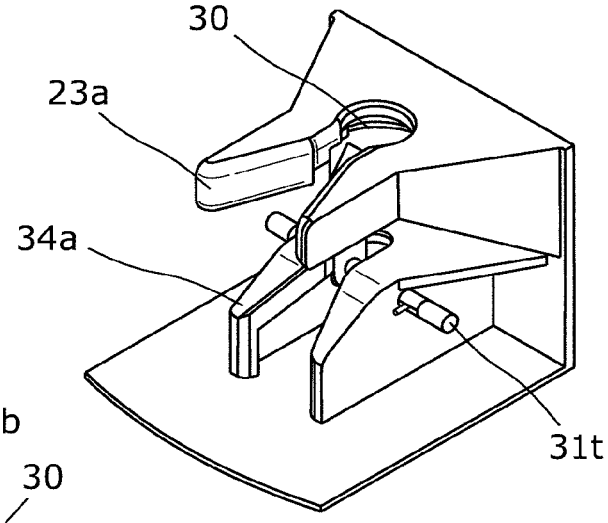
Figure 3C:
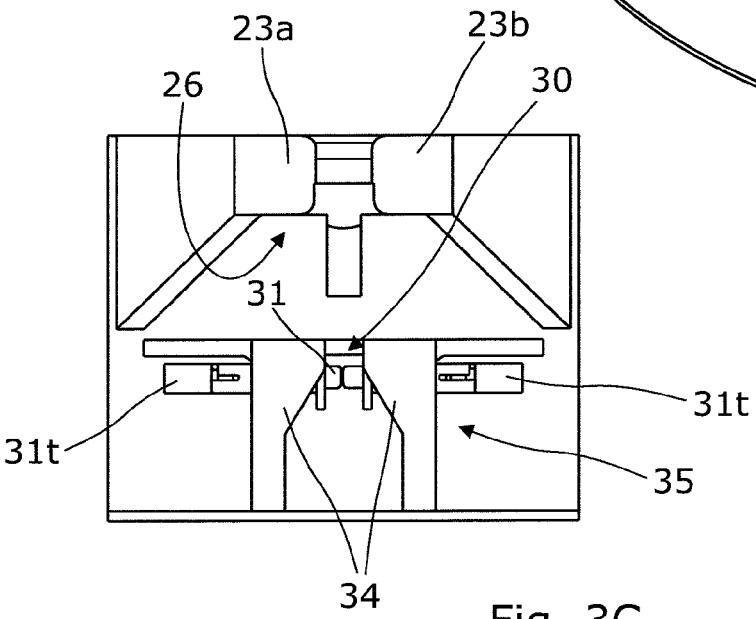
Figure 3D:
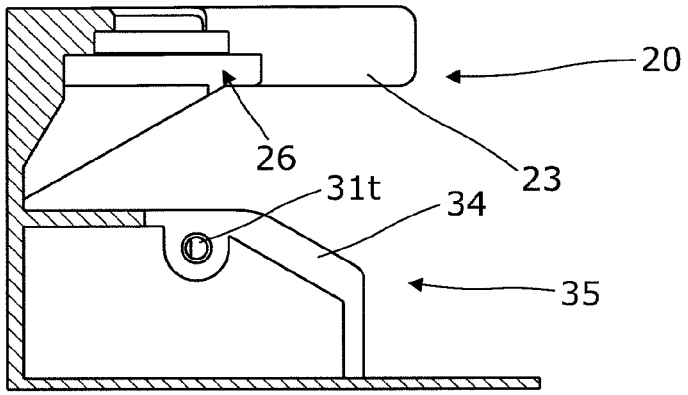
Figure 3E:
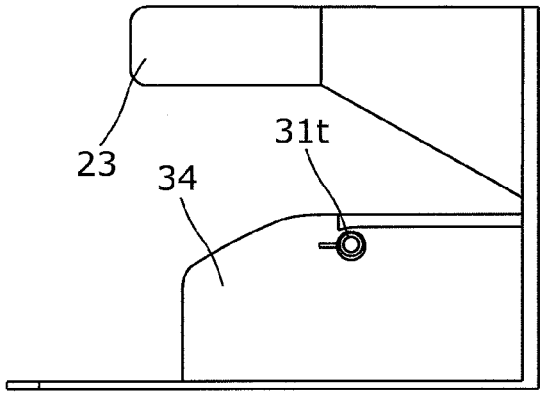
Figure 3F:
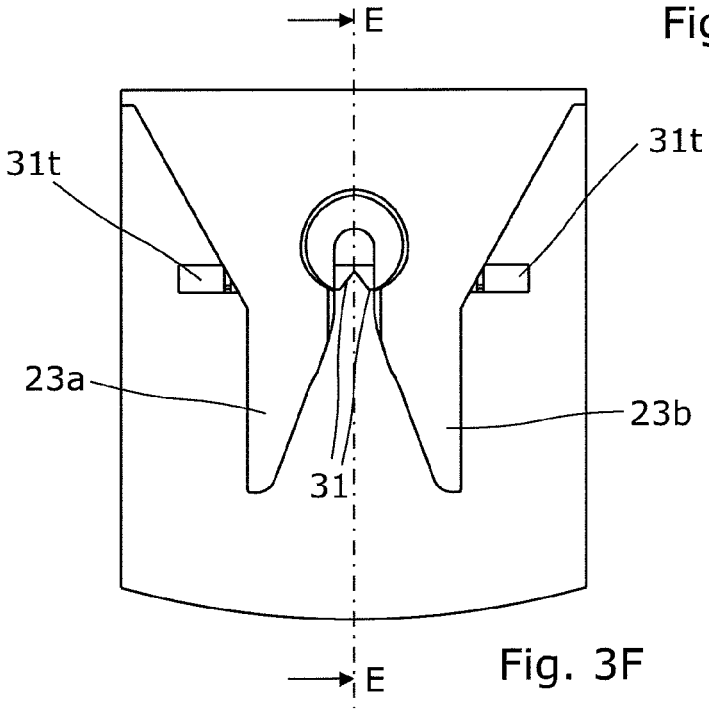

FIG. 3A shows the underside of the porch 20 with socket 21 and guide arms 23 *a,b*. FIGS. 3B-F show alternative views of the porch 20 and latch block 35. The guide arms 23 are typically splayed at the same angle as the legs 34 in the latch block 35.

FIGS. 4 to 6 show the various steps involved in the attachment of the mooring line 10 to the subsea anchor 1. The mooring line 10 has a boot 14 in the form of a cone on top of the locking head 11. The boot 14 guides the locking head 11 onto the seat 26 as the head 11 moves towards the seat 26. The locking head 11 has a bearing ring 15 to engage the seat 26. The bearing ring 15 can typically comprise a bearing material such as D-glide, available from Drie-D. The bearing ring 15 can optionally have a spherical lower bearing surface 15*b*, best shown in FIG. 12D, which engages with the upper bearing surface 11*b* of the head 11, which is typically also at least partially spherical and typically has the same radius of curvature as the lower bearing surface 15*b*. Optionally the upper bearing surface 15*s* of the bearing ring can also be spherical, but in this case the bearing ring 15 has a flat upper annular surface 15*s* to bear axially against the downwardly facing surface of the seat 26 (see FIG. 3D) and a radially outwardly facing bearing surface in the form of a cylindrical section. The locking head 11 typically has reinforcing struts 16 to support the bearing ring against deformation under compression when the mooring line is tensioned.

The locking head 11 is offered up to the socket by moving the head 11 laterally towards it, so that the head 11 moves between the arms 23 on the porch 20 and between the forked legs 34 on the latch block 35. The legs 34 and the guide arms 23 guide the head 11 laterally so that the spigot 13 moves between the legs 34 towards the recess. The spigot 13 pushes the pins 31 radially outwards within the tubes 31*t* from the opening to the recess 30 as a result of the chamfered outer faces of the pins 31, which are pressed apart by the spigot 13 as it passes into the recess 30. The pins 31 are resiliently biased inwards, so the pins move apart against the resilient bias of the springs in the tubes 31*t* as the spigot 13 passes between them into the recess 30, and when the spigot 13 has entered the recess 30, the pins 31 are free to move back together under the force of the resilient springs to lock the spigot within the recess 30. The inner ends of the pins 31 are only chamfered on the outside of the pins so the spigot is retained within the recess 30 when the pins 31 close together. Before the spigot 13 is engaged in the recess 30 the assembly is in a first unlocked configuration, as shown in FIG. 4. In this configuration, the head 11 is free to move in relation to the socket 20 and the locking head 11 and spigot 13 are disengaged from the socket 21 and latch block 35 respectively.

When the spigot 13 is within the recess 30, the assembly is in the second locked configuration, as shown in FIG. 5. In this configuration, the axis of the head 11 is aligned with the axis of the socket 20. The spigot 13 of the locking head 11 is engaged in the recess 30 of the latch block 35.

In the embodiment shown in the drawings, the latch block 35 has a ramp 32, extending from the outer face of the legs 34 to their junction with the recess 30. The ramp 32 guides the head axially with respect to the socket 21, which the legs 34 and arms 23 guide the head laterally. By moving the spigot 13 between the legs 34, the head is lifted up the ramp 32 to move axially upwards into the socket 21.

Once the head has reached the locked configuration shown in FIG. 5, it is pulled up by tensioning the mooring line 10, to pull the bearing ring 15 on the uppermost face of the head 11 into engagement with the seat 26 of the socket 21. In the FIG.

5 configuration before the head 11 is pulled up into the socket, the spigot is locked in the recess 30 in the latch block 35, so the head 11 cannot move back down the ramp 32 and cannot disengage with the porch 20. Also, the boot 14 has entered the socket 21, and resists movement of the head out of alignment with the socket. Once the locking head 11 is aligned with the socket as shown in FIG. 5, the assembly can be moved to a locked configuration as shown in FIG. 6. In this configuration, the locking head 11 is fully pulled up into the socket 21 and engaged in the seat 26 of the porch 20 and the spigot 13 has been lifted up above the recess 30 of the latch block 35. The latch pins 31 are shown closed across the recess 30. In this FIG. 6 configuration, the head 11 is locked in the socket 21 with the bearing ring held in compression between the spherical upper bearing surface 11*b* of the head 11 and the seat 26. The head cannot move out of the socket as the bearing ring 15 is wider than the neck. The spigot 13 can clear the recess and therefore is not retained within it, allowing the head 11 to swivel and pivot within the socket as a result of the spherical bearings 11*b*, 15*b*, and so the spigot can move outside the boundaries of the recess 30 in the latch block 35. However, the head cannot disengage from the socket 21 while the tension is maintained on the mooring line 10 as it cannot clear the neck of the socket 21.

FIG. 7 is similar to FIG. 6, but shows the mooring line 10 and locking head 11 but in this case, the boot 14 has been removed from the head 11. Removal of the boot 14 after the locking configuration has been reached allows inspection of the bearing surface 15 and socket 21 from above the porch 20. Without a boot the flexibility of the mooring line 10 relative to the socket 21 may also be improved. Optionally the boot 14 can be left in position on the head, and this might be beneficial in some embodiments, as it can reduce the amount of debris collecting in the bearing area.

FIGS. 8, 9 and 10 show an alternative arrangement of an anchoring assembly in which like components have similar reference numbers increased by 100. In the second embodiment, the socket 121 is provided in an upper face 120 of a pile or other anchor 103. The socket 121 receives and retains the same mooring line 10 with head 11 as the previous embodiment, and has arms 123*a* and 123*b*, but unlike the previous embodiment, where the arms 23 have free ends, in the present embodiment, the arms are extended and connected to define a landing enclosure 124, which in this embodiment is generally circular, although other shapes can be used. The landing enclosure 124 typically has a continuous boundary, but this is not essential and embodiments of the assembly can have landing enclosures that are not closed loops. FIG. 8 shows one socket 121 and one landing enclosure 124. FIGS. 9 and 10 show two sockets 121*a*, 121*b*, for securing two mooring lines 10, that share a common landing enclosure 124. FIGS. 8, 9 and 10 show the sockets 121 and landing enclosure 24 inside the pile 103*a*.

The circumference or boundary of the landing enclosure 124 has a larger inner diameter than the internal or inner diameter of the socket(s) 121. The head 11 can therefore be landed in the landing enclosure 124 and subsequently moved laterally into the socket. The larger diameter of the landing enclosure 124 means that it is an easier target to hit when lowering the head from a deployment vessel. When the head 11 is received within the landing enclosure 124, the spigot 13 on the base of the head is guided to the apex 140 of a V-shaped trough 141 (see FIG. 10). The apex 140 of the trough extends under the socket 121, so that subsequently drawing the head 11 towards the socket 121 with the spigot 13 engaged in the apex 140 of the trough ensures that the head 11 is correctly guided into alignment with the socket and with the seat. Once the head 11 is drawn sideways so that the mooring line 10 is passing through the socket 121, the mooring line 10 can be tensioned to pull the head 11 up into engagement with the seat as previously described.

Figure 11A:
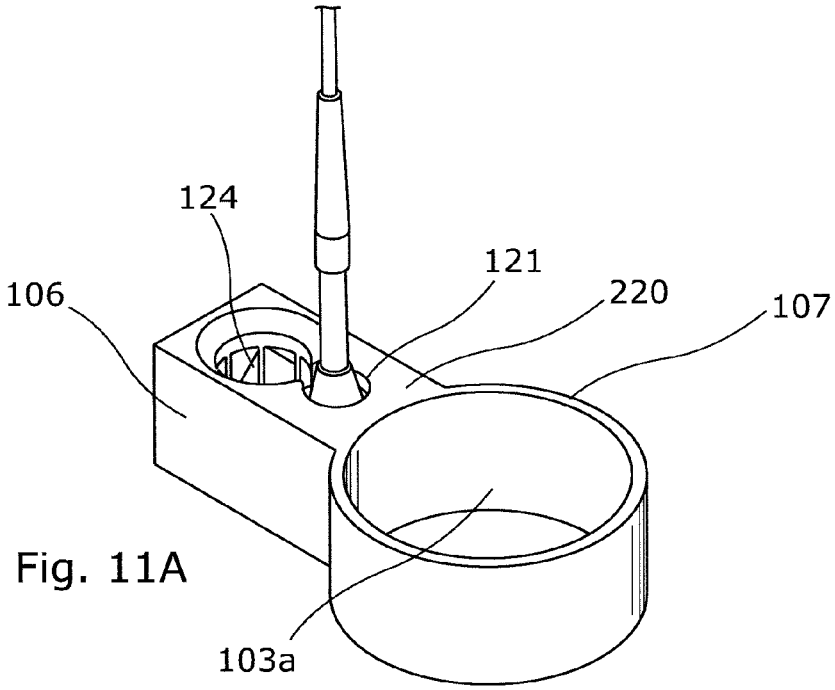
Figure 11B:
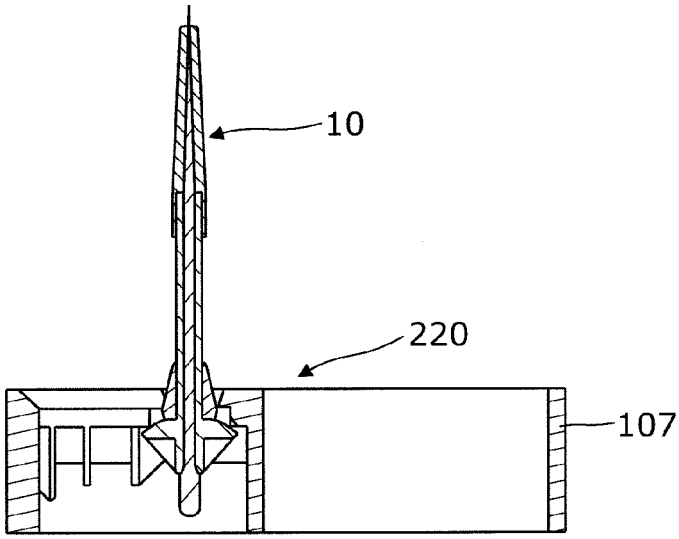
Figure 11C:
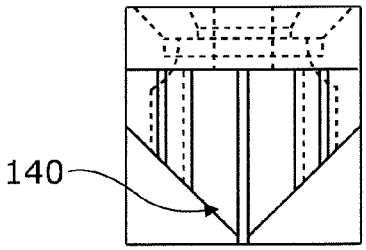
Figure 11D:
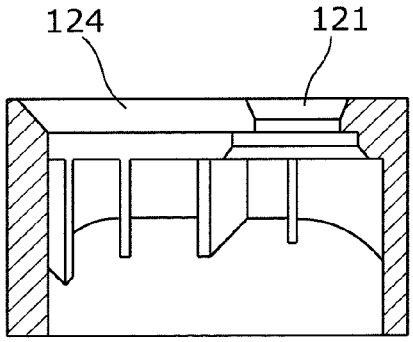
Figure 11E:
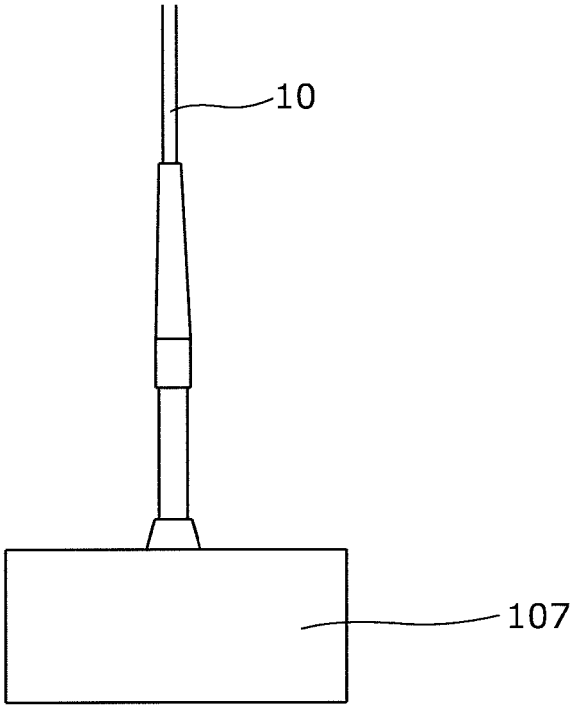
Figure 11F:
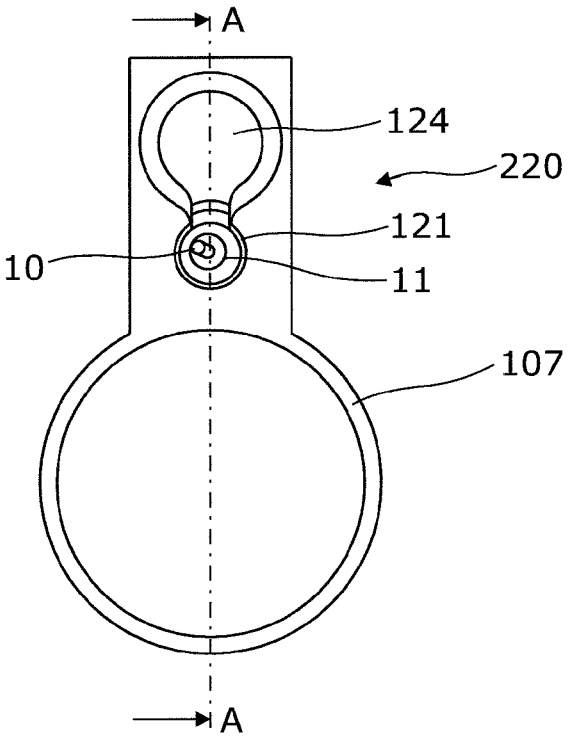
Figure 12A:
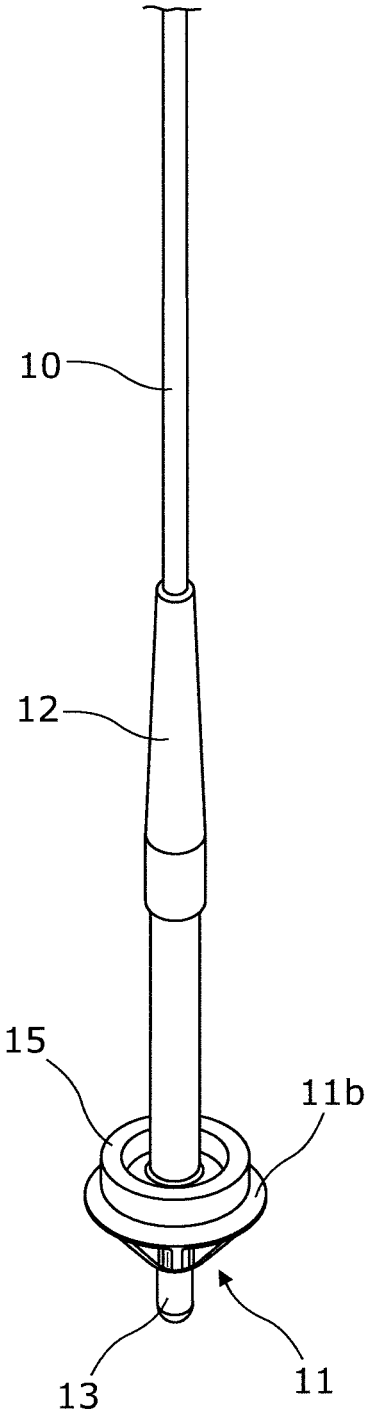
Figure 12B:
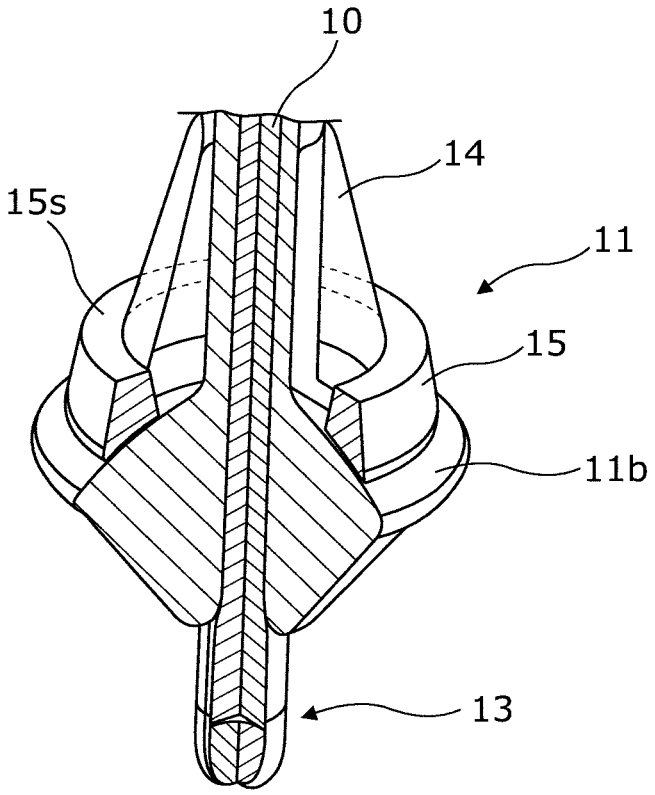
Figure 12C:
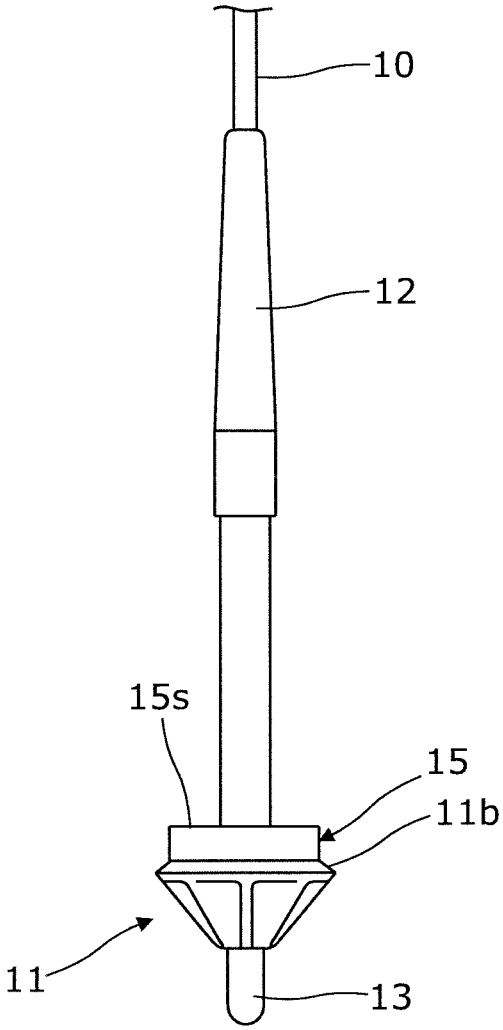
Figure 12E:
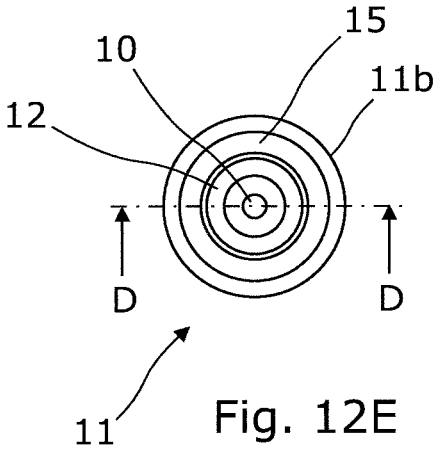
Figure 12D:
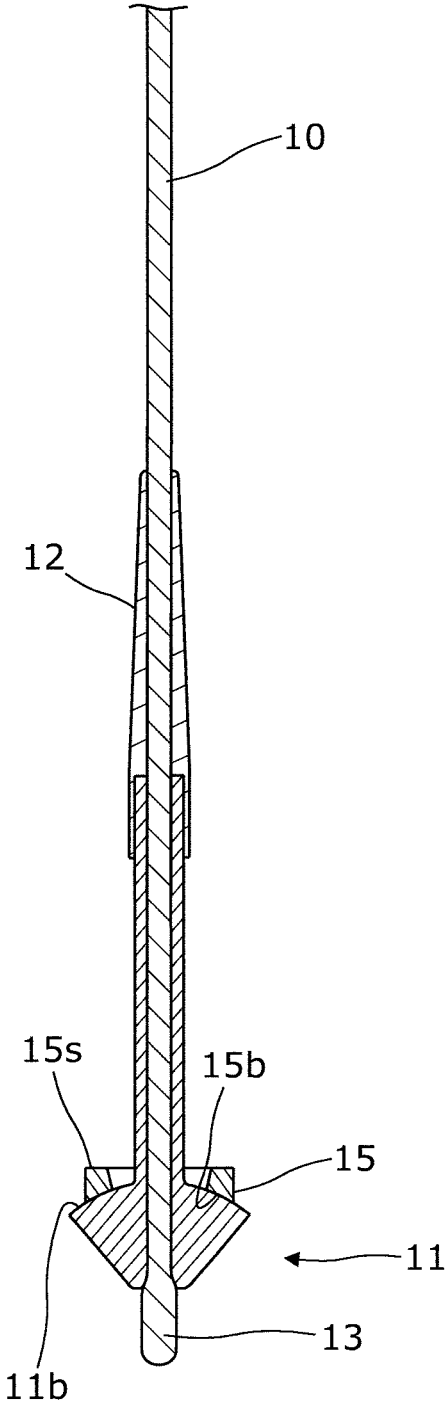

FIG. 11A shows a further embodiment with a socket 121 and landing enclosure 124 positioned at the side of the pile 103*a*. A hang-off 106 attached to a band 107 secures the porch 220 to the pile 103*a*. The band 107 extends around the pile 103*a*. Optionally the socket 121 can form part of the pile (e.g. it can be formed integrally with the pile) or it can be formed separately and attached during or after installation of the pile. Porches can be optionally installed at any angle so that they can be used with spread moorings.

FIG. 12 shows the locking head 11 at the end of the mooring line 10 and sleeve 12. The locking head 11 has a bearing ring 15 to engage the seat 26 shown in FIG. 3A. The surface of the bearing ring 15 is optionally partially spherical and is typically formed with a low friction material. This reduces the friction between the locking head 11 and the seat 26 of the socket 21. The bearing ring 15 can optionally be formed from or faced with a layer of fluoropolymer material. The locking head 11 is typically formed integrally with the mooring line 10, or can optionally incorporate a ball secured to the end of the mooring line 10.

Modifications and improvements can be incorporated without departing from the scope of the invention.

The invention claimed is:

1. A subsea anchoring assembly, comprising:

an anchor;

a locking head for connection of a mooring line to the anchor; and a socket provided on the anchor and having a seat adapted to receive and seat the locking head within the socket;

the socket having a neck provided with a guide device to direct the locking head into alignment with the socket;

wherein the locking head and the socket can move between a first configuration in which the locking head and the socket are separate, and a second configuration in which the locking head and the socket are locked together;

wherein the anchor comprises a recess and a locking member, and the head comprises a latching device comprising a spigot adapted to engage in the recess and to be locked in the recess by the locking member; and wherein the locking member permits the spigot to move into the recess, but restricts or prevents movement of the spigot out of the recess; and wherein the seat is partially spherical.

2. A subsea anchoring assembly as claimed in claim 1, wherein the locking member restricts or prevents movement of the spigot out of the recess, and thus prevents movement of the head out of the socket.

3. A subsea anchoring assembly as claimed in claim 2, wherein the locking member comprises one or more locking pins, which permit the spigot to move into the recess, but which restrict movement of the spigot out of the recess.

4. A subsea anchoring assembly as claimed in claim 1, wherein when the spigot is located in the recess, the head is axially aligned with the seat on the socket.

5. A subsea anchoring assembly, comprising:

an anchor;

a locking head for connection of a mooring line to the anchor; and a socket provided on the anchor and having a seat adapted to receive and seat the locking head within the socket;

the socket having a neck provided with a guide device to direct the locking head into alignment with the socket;

wherein the locking head and the socket can move between a first configuration in which the locking head and the socket are separate, and a second configuration in which the locking head and the socket are locked together; and wherein the guide device comprises a pair of splayed arms and a landing enclosure with a substantially continuous boundary extending from one side of the neck to the other; and wherein the outer ends of the splayed arms extend so that they connect to one another to form the boundary.

6. A subsea anchoring assembly as claimed in claim 5, wherein the inner diameter of the landing enclosure is up to three times the inner diameter of the socket.

7. A subsea anchoring assembly as claimed in claim 5, wherein the landing enclosure is provided with more than one socket that is contiguous with the landing enclosure.

8. A subsea anchoring assembly, comprising:

an anchor;

a locking head for connection of a mooring line to the anchor; and a socket provided on the anchor and having a seat adapted to receive and seat the locking head within the socket;

the socket having a neck provided with a guide device to direct the locking head into alignment with the socket;

wherein the locking head and the socket can move between a first configuration in which the locking head and the socket are separate, and a second configuration in which the locking head and the socket are locked together; and the anchoring assembly further comprising a ramp adapted to guide the head or the mooring line through the neck and into the socket, wherein the seat on the socket faces the ramp.

9. A subsea anchoring assembly as claimed in claim 8, wherein the assembly is adapted such that when the head has moved along the ramp the head is in axial alignment with the seat.

10. A subsea anchoring assembly as claimed in claim 8, wherein the ramp comprises forked legs with a groove between them.

11. A subsea anchoring assembly as claimed in claim 10, wherein the guide device further comprises a pair of splayed arms and the legs are splayed and extend at the same angles as the splayed arms.

12. A subsea anchoring assembly as claimed in claim 10, wherein the locking head includes a spigot, and wherein the spigot extends between the forked legs of the ramp, locating in a recess between the legs.

13. A subsea anchoring assembly as claimed in claim 12, wherein the recess is axially aligned with the socket.

14. A subsea anchoring assembly as claimed in claim 12, wherein the ramp is provided with latch pins to retain the spigot within the recess.

15. A subsea anchoring assembly as claimed in claim 1, wherein the seat is adapted to engage with a spherical or partially spherical bearing on the head, enabling the head to pivot and swivel in the seat.

16. A subsea anchoring assembly as claimed in claim 1, wherein the entrance to the neck has arcuate walls adapted to guide the mooring line or the head into the neck, and into alignment with the socket.

17. A subsea anchoring assembly as claimed in claim 1, wherein the head comprises a boot in the form of a cone on top of the head adapted to guide the head laterally onto the seat.

18. A subsea anchoring assembly as claimed in claim 17, wherein the head has a bearing surface to engage the seat located below the boot.

19. A subsea anchoring assembly as claimed in claim 18, wherein the boot is removable from the head when the bearing surface of the head is engaged with the seat.

20. A subsea anchoring assembly as claimed in claim 17, wherein the boot is adapted to restrict lateral movement of the head in the socket.

21. A subsea anchoring assembly as claimed in claim 1, wherein the assembly comprises a plurality of locking heads and sockets on each anchor to allow a plurality of mooring lines to be connected to that anchor.

22. A subsea anchoring assembly as claimed in claim 1, wherein the guide device comprises a pair of splayed arms, each extending in a different direction.

23. A subsea anchoring assembly as claimed in claim 1, wherein the head and the socket have cooperating bearing surfaces.

24. A subsea anchoring assembly as claimed in claim 23, wherein the bearing surfaces comprise a layer or coating of material that reduces friction between the head and the socket.

25. A subsea anchoring assembly as claimed in claim 23, wherein the cooperating bearing surfaces allow the head to pivot and swivel in the seat.

26. A subsea anchoring assembly as claimed in claim 1, wherein the end of the mooring line is formed into the head by moulding at least a portion of the head around the end of the line.

27. A subsea anchoring assembly as claimed in claim 1, wherein the head comprises a ball secured to an end of the mooring line.

28. A subsea anchoring assembly as claimed in claim 1, wherein the head comprises a sleeve.

29. A subsea anchoring assembly as claimed in claim 28, wherein the sleeve has a flange engaging the seat.

30. A method of anchoring an object to a subsea anchor comprising:

providing a locking head on a mooring line;

providing an anchor having a socket and a partially spherical seat adapted to receive and seat the locking head within the socket, wherein the socket has a neck provided with a guide device to direct the locking head into alignment with the socket, the guide device comprising a landing enclosure with a substantially continuous boundary extending from one side of the neck to the other;

the method further comprising:

landing the head on the landing enclosure, before moving the head laterally through the neck to move the head into alignment with the socket;

moving the head into the socket; and locking the head within the socket.

31. The method of claim 30, comprising the guide device engaging the mooring line or the head, and directing it through the neck and into the socket.

32. The method of claim 30, wherein in the locked position, the head is axially aligned with the seat on the socket.

* * * * *